US012649557B1

(12) United States Patent
Berta, Jr.

(10) Patent No.: US 12,649,557 B1
(45) Date of Patent: Jun. 9, 2026

(54) SWIVEL MOUNTS FOR ATTACHING AND MANEUVERING ACCESSORIES OVER THE GUNNEL OF A BOAT OR ANY OTHER MOUNTING SURFACE

(71) Applicant: Sea Swivel Inc., Key Largo, FL (US)

(72) Inventor: Mark S. Berta, Jr., Key Largo, FL (US)

(73) Assignee: Sea Swivel Inc., Key Largo, FL (US)

( * ) Notice: Subject to any disclaimer, the term of this patent is extended or adjusted under 35 U.S.C. 154(b) by 0 days.

(21) Appl. No.: 19/409,060

(22) Filed: Dec. 4, 2025

Related U.S. Application Data

(63) Continuation of application No. 19/321,921, filed on Sep. 8, 2025, which is a continuation of application No. 19/078,523, filed on Mar. 13, 2025, now Pat. No. 12,409,922, which is a continuation of application No. 18/897,527, filed on Sep. 26, 2024, now Pat. No. 12,258,111.

(60) Provisional application No. 63/540,483, filed on Sep. 26, 2023.

(51) Int. Cl.
*B63H 20/06* (2006.01)
*B63H 20/00* (2006.01)

(52) U.S. Cl.
CPC ..... *B63H 20/06* (2013.01); *B63H 20/007* (2013.01)

(58) Field of Classification Search
None
See application file for complete search history.

(56) References Cited

U.S. PATENT DOCUMENTS 2,779,642 A * 1/1957 Matthews ..... A47B 11/00 384/615
3,199,826 A * 8/1965 Miller ..... A47C 3/18 297/252
3,604,674 A 9/1971 Wilkerson
3,897,086 A 7/1975 Breford
3,999,500 A 12/1976 Friedel et al.
4,044,489 A 8/1977 Henze et al.
(Continued)

OTHER PUBLICATIONS

Widerman Malek, PL; Petition for Post-Grant Review of U.S. Pat. No. 12,258,111 before the United States Patent and Trademark Office Patent Trial and Appeal Board; Sep. 25, 2025; 108 pages.
(Continued)

*Primary Examiner* — Steven M Marsh
(74) *Attorney, Agent, or Firm* — Egan, Enders & Huston LLP.

(57) ABSTRACT

Swivel mounts, mounting assemblies for boating accessories, and boats having such are disclosed. The swivel mounts include a support member, a mounting member, and a swivel element for enabling the mounting member to swivel relative to the support member. In some cases, a trolling motor mount bracket and/or a trolling motor may be coupled to the swivel mount. In further embodiments, the swivel mount may be coupled to a surface of a boat, such as but not limited to a boat gunnel. In particular, a swivel mount may be configured and disposed above an upward facing surface of the gunnel such that a mounting member of the swivel mount is able to swivel about an axis that is perpendicular to and passes through the upward facing surface of the gunnel. Mounting members having a hole pattern to accommodate different types of trolling motors is also provided.

25 Claims, 10 Drawing Sheets

(56) References Cited

U.S. PATENT DOCUMENTS

| | | | | |
|---|---|---|---|---|
| 4,076,346 | A | 2/1978 | McMahan | |
| 4,322,208 | A | 3/1982 | Kelpin | |
| 4,401,287 | A * | 8/1983 | Moeser | B63B 29/04 248/349.1 |
| 4,640,486 | A | 2/1987 | Neville | |
| 4,715,259 | A | 12/1987 | Wittman | |
| 4,919,383 | A | 4/1990 | Benjamin | |
| 5,002,509 | A * | 3/1991 | Uroszek | B63H 20/007 440/49 |
| D323,509 | S | 1/1992 | Dimmitt | |
| 5,080,322 | A | 1/1992 | Harley | |
| 5,174,542 | A | 12/1992 | DeLeeuw | |
| 5,400,958 | A | 3/1995 | Walker | |
| 5,607,136 | A | 3/1997 | Bernloehr | |
| 5,685,514 | A | 11/1997 | Carnahan | |
| 5,779,309 | A | 7/1998 | Lu | |
| 6,053,471 | A | 4/2000 | Brown | |
| 6,231,020 | B1 | 5/2001 | Wilson | |
| 6,338,464 | B1 | 1/2002 | Jen-Hsiang | |
| 6,684,558 | B1 | 2/2004 | Gillespie | |
| 7,302,901 | B1 | 12/2007 | Meyer | |
| 7,399,211 | B1 | 7/2008 | Spaulding | |
| 7,448,812 | B2 | 11/2008 | Heibel | |
| 7,975,969 | B2 | 7/2011 | Jan | |
| 9,829,148 | B2 | 11/2017 | Choquette | |
| D812,099 | S | 3/2018 | Johnson | |
| D813,648 | S | 3/2018 | Karol | |
| D832,970 | S | 11/2018 | Jen | |
| D937,071 | S | 11/2021 | Pavlov | |
| 11,305,855 | B1 | 4/2022 | Payne | |
| 11,584,495 | B2 | 2/2023 | Hunziker, II | |
| D986,710 | S | 5/2023 | Wang | |
| 12,064,379 | B2 | 8/2024 | Bellows | |
| 12,258,111 | B1 | 3/2025 | Berta, Jr. | |
| 12,409,922 | B1 | 9/2025 | Berta, Jr. | |
| 2003/0194921 | A1 | 10/2003 | Leiss et al. | |
| 2009/0101786 | A1 | 4/2009 | Faull | |
| 2010/0242828 | A1 | 9/2010 | Gratsch | |
| 2015/0336699 | A1* | 11/2015 | Fahldieck | B65B 43/46 198/803.3 |
| 2016/0356415 | A1 | 12/2016 | Moore | |
| 2023/0356807 | A1 | 11/2023 | Ratzlaff | |
| 2024/0043107 | A1 | 2/2024 | Weskamp | |
| 2025/0012910 | A1 | 1/2025 | Bird | |

OTHER PUBLICATIONS

Russel Taylor, Declaration of Expert, Russell Taylor in Support of Petitioner, Shuttleslide, LLC's Petition for Post-Grant Review of U.S. Pat. No. 12,258,111 Under 35 U.S.C. § 321 and 37 C.F.R. § 42.200, Case No. Unassigned; Sep. 24, 2025; 28 pages.

Neal Trombley; Declaration of Neal Trombley in Support of Petitioner, Shuttleslide, LLC's Petition for Post-Grant Review of U.S. Pat. No. 12,258,111 Under 35 U.S.C. § 321 and 37 C.F.R. § 42.200, Case No. Unassigned and documents referenced in the declaration as Exhibit Shuttleslide 1012 and Exhibit Shuttleslide 1015; Sep. 24, 2025; 11 pages.

Chris Woodward, "Grady-White 251 Coastal Explorer Review" published in Sports Fishing Mag at https://www.sportfishingmag.com May 15, 2014 and marked post-publishing with "Shuttleslide 1014" in the lower right hand corner of each page correlating to the exhibit No. referenced in the Petition for Post-Grant Review of U.S. Pat. No. 12,258,111; 16 pages.

The Wayback Machine; "Edson Vision Series Mounting Plate—Universal Radar Dome 2/4kw", retrieved from the internet on Sep. 17, 2025 and marked post retrieval with "Shuttleslide 1010" in the lower right hand corner of each page correlating to the exhibit No. referenced in the Petition for Post-Grant Review of U.S. Pat. No. 12,258,111; 5 pages.

Product Review_SeaSwivel Trolling Motor Mount.—YouTube, posted date Dec. 14, 2023. Retrieved from internet, https://youtube.com/watch?v=Dw7epaQwsZc (Year: 2023). Screenshots and text of video provided in writing, 7 pages.

United States Patent and Trademark Office, Notice of Decisions on Institution dated Mar. 17, 2026, 3 pages.

United States Patent and Trademark Office; Notice of a petition filed in Pat. No. 12,258,111, U.S. Appl. No. 18/897,527 on Sep. 25, 2025 before the United States Patent and Trademark Office Patent Trial and Appeal Board; Sep. 25, 2025, 2 pages.

* cited by examiner

SWIVEL MOUNTS FOR ATTACHING AND MANEUVERING ACCESSORIES OVER THE GUNNEL OF A BOAT OR ANY OTHER MOUNTING SURFACE

CONTINUING DATA

This application is a continuation of U.S. patent application Ser. No. 19/321,921 filed Sep. 8, 2025, which is a continuation of U.S. patent application Ser. No. 19/078,523 filed Mar. 13, 2025, now U.S. Pat. No. 12,409,922, which is a continuation of U.S. patent application Ser. No. 18/897,527 filed Sep. 26, 2024, now U.S. Pat. No. 12,258,111, which claims priority to U.S. Provisional Patent Application No. 63/540,483 filed Sep. 26, 2023.

BACKGROUND OF THE INVENTION

1. Field of the Invention

This invention generally relates to swivel mounts and, more specifically, to swivel mounts for attaching and maneuvering accessories, such as but not limited to trolling motors, on and over the gunnel of a boat or any other mounting surfaces.

2. Description of the Related Art

The following descriptions and examples are not admitted to be prior art by virtue of their inclusion within this section.

Trolling motors are used to move a boat at a relatively low speed, offering a means to more easily maneuver a boat in a small area, keep the boat moving at a slow speed for troll fishing, or keep a boat from drifting from a desired location in cases in which the trolling motor includes a global positioning system. Despite their usefulness, the configuration of a boat to which a trolling motor is mounted as well as the size of the body of water in which a boat is used can present challenges regarding the manner to mount and store trolling motors in a boat. For instance, trolling motors are generally attached near the edge of the transom or bow of a boat and, in either case, as close to the centerline of the boat as possible. In some cases, the position at which a trolling motor is attached to the transom and/or bow of a boat may not be readily accessible from the deck of a boat. For instance, the transom and/or bow may have storage areas and/or may be designed with ledges which require a boater to climb up on to access a trolling motor. Such action may be precarious for some boaters, placing at them risk to fall either overboard or back into the deck.

Furthermore, propellers of trolling motors must be adequately submerged in the water when in use and, as such, the shaft lengths of trolling motors are generally proportional to the size of the boat with which it will be used and particularly to the freeboard height of the boat when the trolling motor is to be mounted near the bow of the boat. As a consequence, managing the placement of long trolling motors in large boats (i.e., particularly when the trolling motors are brought out of the water into the boats) can be a challenge. In some cases, the position at which a trolling motor is mounted near the bow is governed such that the shaft of the trolling motor may be aligned with and secured above the gunnel of the boat during storage, particularly so that the trolling motor does not obstruct space in the boat when it is stored. Such positioning, however, may be difficult to accomplish in some boat configurations. Moreover, boating on large bodies of water presents challenges to the use of trolling motors. In particular, the commotion caused by large waves can exert a significant amount of force (both laterally and vertically) against trolling motors suspended from a side of a boat (i.e., particularly if the waves are large enough to cause the propeller of the trolling motor to toggle from being in and out of the water). As a consequence, the manner in which the trolling motor is mounted to a boat needs to be sufficient to withstand such forces.

Therefore, it would be advantageous to develop new mounts to secure trolling motors or other boating accessories to a surface on a boat, particularly to address one or more of the aforementioned challenges.

SUMMARY OF THE INVENTION

The following description of various embodiments of mixtures and methods is not to be construed in any way as limiting the subject matter of the appended claims.

An embodiment of a swivel mount includes a mounting plate and a support plate each having first and second opposing faces spaced apart by one or more peripheral sidewalls, but where the support plate has a length less than or equal to half a length of the mounting plate. The swivel mount also includes a swivel element. The swivel mount is configured for the mounting plate, the support plate, and swivel element to be coupled together such that the first faces of the support plate and the mounting plate are parallel and the swivel element, the support plate, and the mounting plate at least partially overlap each other. In addition, the arrangement of the swivel element in its coupling with the mounting plate and the support plate is such that the mounting plate is able to swivel about an axis that is perpendicular to and passing through the first face of the mounting plate at a point spaced from a widthwise center line of the mounting plate.

An embodiment of a boat includes a gunnel and a swivel mount disposed above an upward facing surface of the gunnel such that a mounting member of the swivel mount is able to swivel about an axis that is perpendicular to and passes through the upward facing surface of the gunnel. The boat further includes a trolling motor mounting bracket coupled to an upward facing surface of the mounting member.

BRIEF DESCRIPTION OF THE DRAWINGS

Other objects and advantages of the invention will become apparent upon reading the following detailed description and upon reference to the accompanying drawings in which.

Figure 1:
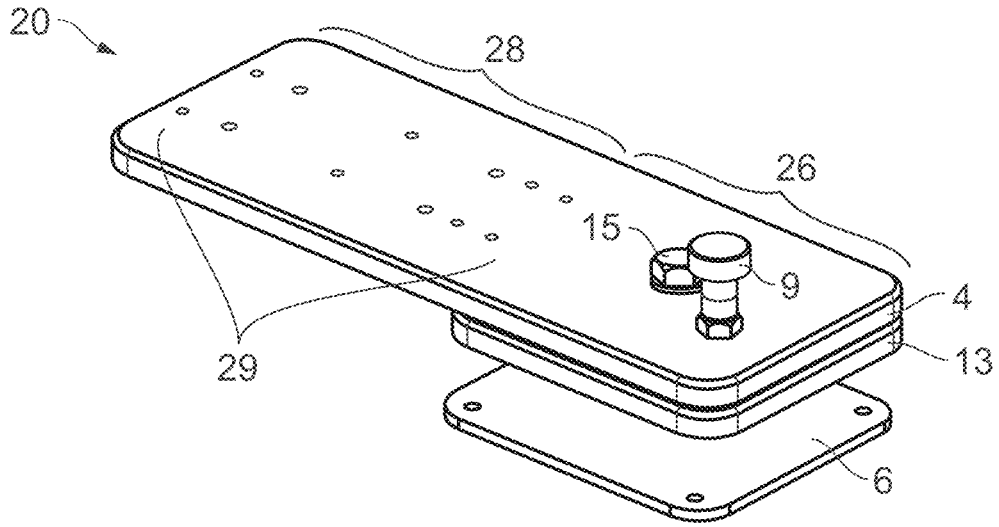
FIG. 1 illustrates a schematic view of an example of a swivel mount.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Swivel mounts for attaching and maneuvering accessories, such as but not limited to trolling motors, on to and over the gunnel of a boat or any other mounting surfaces are disclosed. With regard to the swivel mounts being used with trolling motors, the ability to swivel the trolling motor permits it to be stowed in various positions in a boat, preferably to align with the boat's gunnel. In addition, the ability to swivel a trolling motor further makes the orientation of the trolling motor mounting bracket on the gunnel less important since the trolling motor can be moved to align with the boat's gunnel. Although the description of the swivel mounts provided herein are emphasized for mounting and maneuvering trolling motors onto and over boat gunnels, the application of the swivel mounts is not necessarily so limited. In particular, the swivel mounts described herein may be used for mounting any boating accessory, such as but not limited to a rod holder or a downrigger, or any other object, such as but not limited to a personal electronic device or a marine global positioning system, to a boat gunnel or to any other surface of a boat. In addition, the swivel mounts described herein may be used for mounting objects in environments other than a boat. As set forth in more detail below, swivel mounts described herein may be pre-assembled or may be provided as an assembly kit with instructions on how to assemble the components of the mounts. As further set forth below, the swivel mounts may be included in assemblies having a mounted accessory. Moreover, boats having such swivel mounts and/or mounting assemblies are described.

In general, the swivel mounts disclosed herein include a support member, a mounting member, and a swivel coupling for enabling the mounting member to swivel relative to the support member, particularly about an axis which is perpendicular and passing through a face of the mounting member that is parallel with a receiving face of the support member and is offset from a center point of the mounting member. As set forth in detail below, the swivel coupling may, in some embodiments, include a bushing between the support member and the mounting member, a single bolt for holding the components together and a bearing providing rotation to the bolt and the mounting member. In other cases, the swivel coupling may include one or more annular bearings disposed within the member plate and/or between the support member and the mounting member providing swivel movement to the mounting member. In either case, the swivel mount may include a locking pin assembly for securing the mounting member in a set position relative to the support member. In some cases, a trolling motor mount bracket (such as but not limited to a quick-release trolling motor mounting puck and/or a trolling motor deploy/stow mechanism) may be coupled to the swivel mount. In addition or alternatively, a trolling motor may be coupled to the swivel mount. In yet further embodiments, the swivel mount (with or without the trolling motor mount and/or trolling motor) may be coupled to a mounting surface of a boat, such as but not limited to the gunnel of a boat. In any case, the aforementioned designs of the swivel mount have shown to withstand the high tension, stress, and forces incurred by waves during offshore boating.

As set forth in more detail below, the mounting member and support member may, in some embodiments, be plates each having flat opposing primary faces spaced apart by relatively short peripheral sidewalls. The flat opposing primary faces are surfaces used to couple the members to other objects as well as serve as an interface to which the mounting member swivels relative to the support member. The term "primary faces" as used herein refer to the surfaces of an object having the chief surface area. Although the mounting members and support members described herein are emphasized as plates, the members may have other structural configurations. For instance, a mounting member or a support member may include an additional section not having a flat slender configuration. In addition or alternatively, a mounting member or a support member may have a mounting face which is not flat and uniform, but rather has a contour configured to mate with a surface of a particular object to which it will be joined (such as being concave, convex, stepped, or grooved). As such, although the description of the swivel mounts provided herein emphasizes mounting on to flat surfaces and having a flat surface onto which an object may be mounted, the application of the swivel mounts is not necessarily so limited. Furthermore, regardless of the configuration of the mounting member and support member (i.e., whether they are plates or not), the contour of their areal periphery is not limited to being rectangular or square as depicted in the drawings provided herein.

In some cases, a mounting member of the swivel mounts described herein may be elongated, meaning that it has a longer length dimension than its width dimension. In some of such cases, the elongated member may have a first portion for receiving and/or aligning with one or more components of the swivel element and the support member of the swivel mount and a second portion extending from the first portion which is configured to receive and secure an object to the swivel mount. In this manner, an object mounted to the second portion of elongated mounting member may be laterally spaced a set distance from a pivot point of the swivel mount. A swivel mount having such an offset pivot point enables an object to be supported, and in some cases suspended, apart from the pivot point of the swivel mount. For instance, in cases in which a trolling motor mount bracket is coupled to such a swivel mount, the trolling motor mount bracket as a whole may be laterally spaced a set distance from a pivot point of the swivel mount. A trolling motor mount assembly having such an offset pivot point enables the trolling motor to be deployed over a gunnel and far enough away from the side of the boat. To enable such a configuration, the swivel mounts described herein are designed to have enough strength to counter the weight of an attached trolling motor as well as the forces it may incur in operation. In some cases, a support member of the swivel mounts described herein may have a length less than the mounting member of the swivel mount and, in some cases, a length less than or equal to half the length of the mounting member. As a result, the second portion of an elongated mounting member may be cantilevered from its first portion.

As set forth in more detail below, the swivel mounts disclosed herein may be used for mounting an object to a underlying surface, particularly having the support member of the swivel mount fastened onto a mounting surface and the mounting member arranged above and at least partially overlapping the support member such that an object may be secured to the mounting member at an elevation above the mounting surface to which the support member is fastened. Although the swivel mounts disclosed herein are emphasized for such a mounting configuration, it is noted that the swivel mounts may be alternatively used to mount objects to overlying surfaces or sidewall surfaces. In particular, the swivel mounts disclosed herein may in some cases be flipped (i.e., having the mounting member arranged below the support member) such that an object may be suspended at an elevation below a mounting surface to which the support member is fastened. In other cases, a support member of a swivel mount may be fastened onto a substantially upright mounting surface such that an object may be secured to the mounting member in a direction substantially sideways from the mounting surface to which the support member is fastened.

As noted above, the description of the swivel mounts provided herein are emphasized for mounting and maneuvering boating accessories onto and over boat gunnels. In particular, the swivel mounts described herein may be disposed above an upward facing surface of the gunnel such that a mounting member of the swivel mount is able to swivel about an axis that is perpendicular to and passes through the upward facing surface of the gunnel. In some cases, a swivel mount may include a top assembly coupled to an upward facing surface of a boat gunnel and a bottom assembly coupled to an underside surface of the gunnel. Although it is not necessarily so limited, such a mounting configuration may be particularly advantageous when the bottom assembly includes a bearing. In particular, having a bearing disposed along the underside of the gunnel may advantageously lessen its exposure to water splashing into the boat, in effect reducing its rate of corrosion and increasing its lifespan. Such an advantage may be even more beneficial for boats used in salt water. In any case, the swivel mounts disclosed herein may be particularly applicable for mounting to gunnels with an upward facing surface having a width greater than 4 inches, particularly to accommodate a swivel portion of the mount designed to have enough strength to counter the weight of an attached boating accessory as well as the forces exerted against the accessory during operation of the accessory or the boat. The term "gunnel" as used herein refers to an upper edge of a boat's hull and may be used interchangeably with the term "gunwale". The term is inclusive to the top deck portion at the bow of a boat.

In general, the swivel mounts disclosed herein may be applied to any type of boat, but may be particularly suitable for center console boats since they generally have a bow substantially higher than the deck of the boat and/or offshore boats since they are designed to maneuver in large bodies of water and, consequently, withstand large waves. The term "offshore boat" as used herein refers to a boat designed withstand open water, particularly areas which are more than 30 meters deep. In some cases, the swivel mounts disclosed herein may be particularly suitable for saltwater boats since those type of boats are generally used on large bodies of water. The term "saltwater boat" as used herein refers to a boat having a closed cooling system for its motor and/or a mercathode system for its engine. In alternative cases, the swivel mounts described herein may be used in freshwater boats and/or inshore boats. In addition, the swivel mounts described herein may be used in relatively shallow boats, such as but not limited to flat skiffs and bay boats since those type of boats often have a large top deck.

In general, the swivel mounts disclosed herein may be used for mounting trolling motors of any size, which may be generally governed by the size and type of the boat it is to be mounted. As noted above, the swivel mounts disclosed herein may be particularly applicable for offshore boating and, thus, may be particularly suitable to mounting trolling motors having a shaft length greater than 60 inches and, in some cases, trolling motors having a shaft length greater than 100 inches. More specifically, the swivel mounts considered herein may be designed to withstand the high tension, stress, and forces exerted on trolling motors during offshore boating. In other cases, however, the swivel mounts considered herein need not be used in such rough environments and, thus, swivel mounts may be designed to be less robust in some cases. For example, the swivel element of a swivel mount may have a smaller bolt than as described for the embodiment disclosed in FIGS. 1 and 2 below and/or a swivel mount may not include a reinforcement member for placement on the underside of a boat gunnel. In addition or alternatively, the support member of a swivel mount may be smaller than described for the embodiment disclosed in FIGS. 1 and 2 below. Moreover, either or both of the support member and mounting member may be thinner or may be constructed of a less robust material than described for the embodiment disclosed in FIGS. 1 and 2 below.

Turning to the drawings, examples of swivel mounts and components thereof are depicted in FIGS. 1-5 and 11-15. In addition, FIGS. 6-10 illustrate examples of their use in mounting trolling motors to boats. The shape and relative size of the components of a swivel mount considered herein may vary depending on the design specifications of the swivel mount, the surface to which it will be mounted, and the size of the object which will be mounted to the swivel mount. Thus, the configurations of the swivel mounts considered herein are not necessarily restricted to the depictions in FIGS. 1-15.

Figure 2:
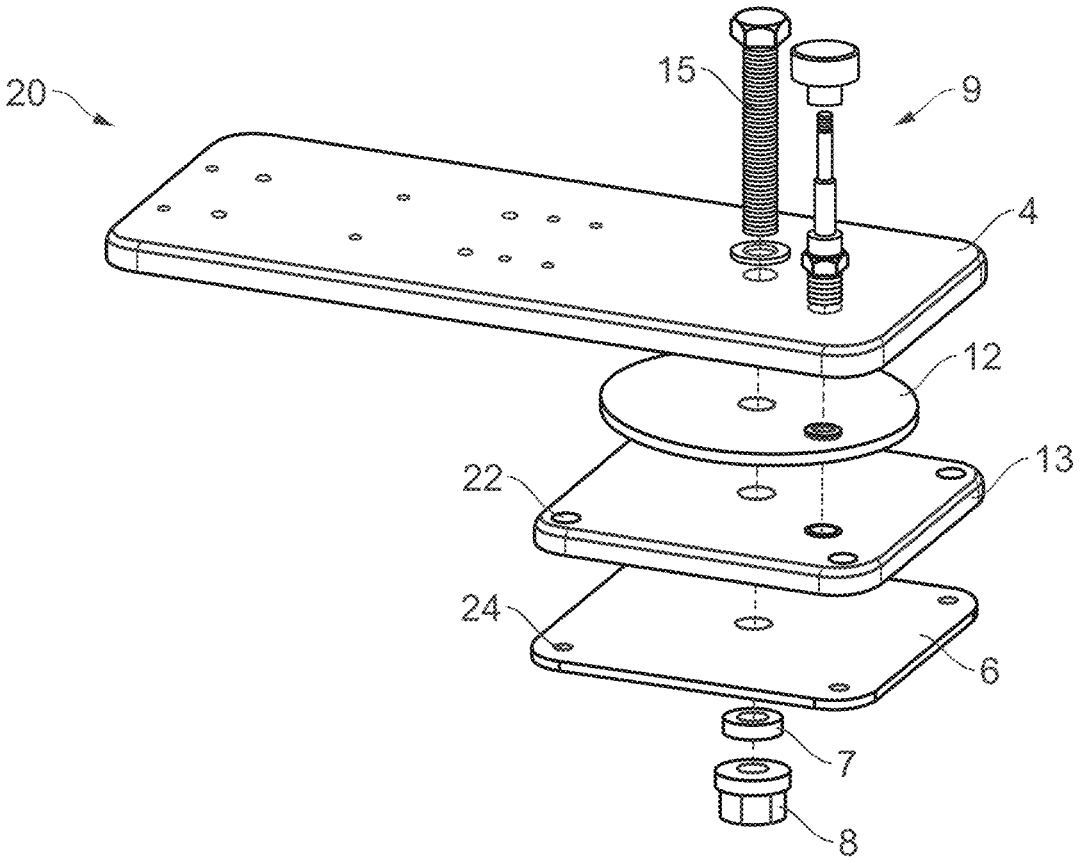
FIG. 2 illustrates an exploded view of the swivel mount depicted in FIG. 1.
Figure 3:
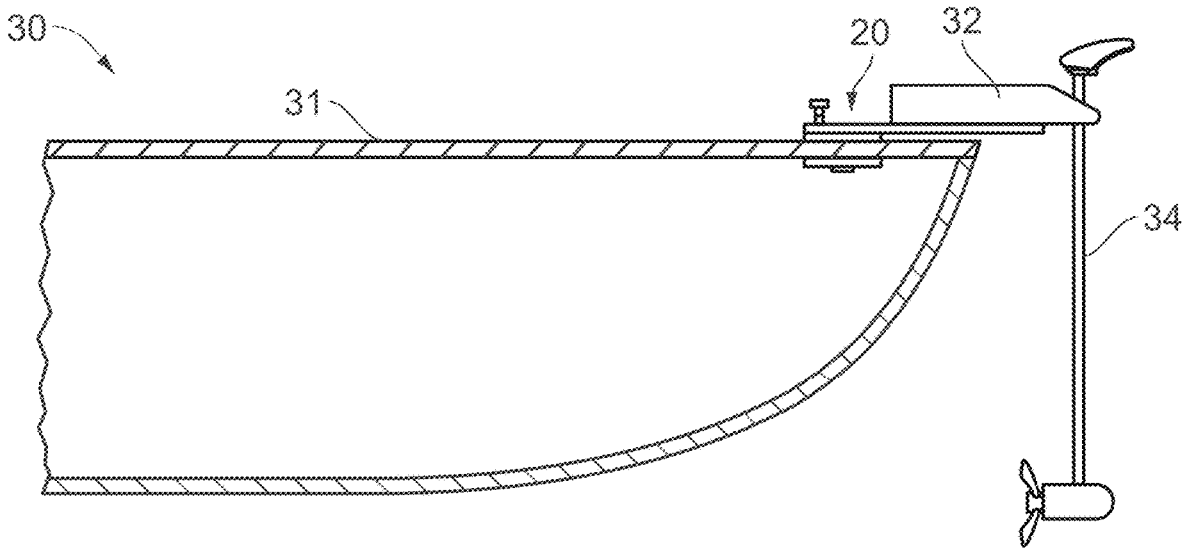
FIG. 3 illustrates a side cross-sectional view of a boat having the swivel mount depicted in FIG. 1 coupled to the boat's gunnel.

FIGS. 1 and 2 respectively illustrate assembled and exploded views of swivel mount 20. As shown, swivel mount 20 includes bolt 15 as well as lower plate 6, bearing 7, middle plate 13, bushing 12, and top plate 4 each having a hole of substantially the same size for receiving bolt 15. In addition, swivel mount 20 includes nut 8 for securing bearing 7 to a bottom of lower plate 6 when bolt 15 is received through the holes of lower plate 6, bearing 7, middle plate 13, bushing 12, and top plate 4. When mounted to a gunnel of a boat, for example, middle plate 13 may be affixed to an upper surface the gunnel and lower plate 6 may be affixed to an underside surface of the gunnel such as shown in the example configuration in FIG. 3. In particular, FIG. 3 illustrates a cross-sectional view of boat 30 taken along gunnel 31 either on the boat's starboard side or port side with a top assembly of middle plate 13, bushing 12 and top plate 4 coupled to an upward facing surface of the gunnel and a bottom assembly of lower plate 6, bearing 7 and nut 8 coupled to an underside surface of the gunnel. FIG. 3 also illustrates trolling motor deploy/stow bracket coupled to the upper surface of top plate 4 with attached trolling motor 34 suspended outside the boat's hull. In other embodiments, middle plate 13 and/or lower plate 6 may be omitted from swivel mount 20 and, thus, in some cases, bushing 12 may be placed on the upper surface of a gunnel of a boat and/or nut 8 may be used for securing bearing 7 against an underside surface of the gunnel.

Regardless of whether swivel mount 20 includes middle plate 13 and/or lower plate 6, swivel mount 20 may, in some cases, be arranged relatively close to the bow of a boat such as shown in FIG. 3. In other cases, however, swivel mount 20 may displaced a few feet from the bow of the boat along its gunnel. Such a configuration may be particularly beneficial for boats in which it is difficult to access the bow of the boat from the deck. In particular, mounting a swivel mount farther from the bow of the boat may allow it to be accessed from the deck of the boat and, thus, may be less precarious for moving a trolling motor attached to the swivel mount in and out of the water. In such cases, in order for the boat to be maneuvered without preference to one side of the boat, a boat may have two trolling motors attached on each side of the boat (port and starboard sides).

In any case, middle plate 13 and lower plate 6 may, in some embodiments, be mounted to a surface, such as a gunnel of a boat, via bolts through corner holes 22 and 24, respectively, and in cases in which both plates are included in a swivel mount, a single bolt may be used for each corresponding pair of corner holes 22 and 24. It is noted that each of the corners of middle plate 13 and lower plate 6 respectively include holes 22 and 24, despite the holes in the one of the corners of each plate not being in view in FIG. 2. In addition or alternatively, middle plate 13 and/or lower plate 6 may be adhered to a surface and, thus, in some cases, middle plate 13 and/or lower plate 6 may not respectively include corner holes 22 and 24. In general, lower plate 6 and middle plate 13 may be advantageous for counteracting forces exerted on swivel mount 20 and any object mounted thereon. Thus, the inclusion of lower plate 6 and/or middle plate 13 in swivel mount 20 may aid in providing a more secure and robust mount for an object, particularly an object suspended from the mount, such as but not limited to a trolling motor over a gunnel of a boat. However, if the environment in which the swivel mount is to be used is not expected to induce strong lateral forces, lower plate 6 and/or middle plate 13 may be omitted. For instance, if the body of water in which a boat is to be used is not expected to have large waves and/or the shaft of a trolling motor attached to the swivel mount is relatively short, the forces exerted against the swivel mount and trolling motor may be minimal and, thus, a swivel mount not having lower plate 6 and/or middle plate 13 may be sufficient for use without concern of causing damage to the boat or the trolling motor. In light thereof, either or both of lower plate 6 and middle plate 13 may serve as a support member of the swivel mounts described herein.

Figure 12:
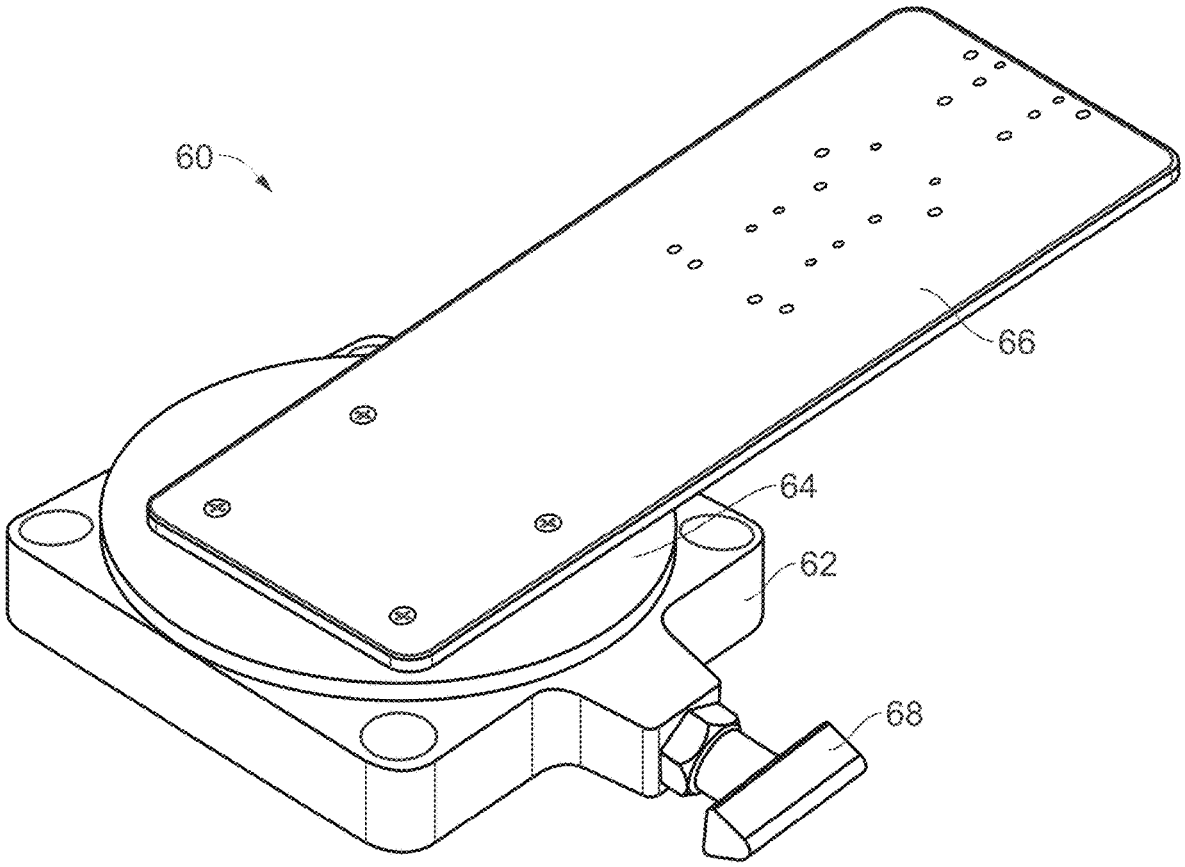
FIG. 12 illustrates a perspective view of yet another example of a swivel mount.

The size and material of bolt 15 may further aid in counteracting forces exerted on swivel mount 20 and any object mounted thereon. For the development of the swivel mount disclosed herein, a ¾ inch stainless steel bolt was shown to provide sufficient strength for supporting a trolling motor having a 108 inch shaft length in an offshore boating environment. However, smaller or larger bolts and/or bolts of different materials may be considered depending on the size of the trolling motor and the environment in which is it to be used. Another component of swivel mount 20 which may aid in counteracting forces exerted on swivel mount 20 and any object mounted thereon is in the inclusion of locking pin assembly 9. In particular, locking pin assembly 9 is used to secure top plate 4 in a set position relative to middle plate 13 (or to a surface on which swivel mount 20 is mounted) and by doing so aids in counteracting forces exerted on swivel mount 20. The vertical orientation of the locking pin assembly may be particularly beneficial for counteracting forces exerted on swivel mount 20, but a horizontally oriented locking pin assembly such as shown in FIG. 12 may be suitable in some cases depending the size of the object to be suspended by swivel mount 20 and the environment in which it is to be used.

In any case, the locking pin assembly may have any type of configuration, including but not limited to including either a detent pin and/or a pull pin. In addition, the locking pin assembly may, in some cases, be a spring-loaded pin, a magnetic release pin, or an index plunger such that it automatically falls into its receiver when in the deployed position. In some cases, the locking pin assembly may be configured for manual actuation by a user, but in other embodiments it may be configured for automated movement. In latter of such cases, the automated movement of the locking pin assembly may, in some cases, be dependent on whether a trolling motor deploy/stow mechanism attached to the swivel mount was recently activated to bring a trolling motor out of the water and into a stowed position relative to the boat gunnel and/or whether the trolling motor deploy/stow mechanism has been recently activated to deploy a stowed trolling motor over the gunnel and into the water. To enable such dependency of movement, the swivel mount may, in some cases, include a switch for detecting activation of the trolling motor deploy/stow mechanism and subsequently activating the locking pin assembly. Alternatively, the swivel mount and the trolling motor deploy/stow mechanism may be configured for electrical communication with each other (i.e., either wired or wireless communication) to affect such dependency of movement. The latter embodiment may be particularly applicable but is not limited to embodiments in which the swivel mount is integrated into a trolling motor deploy/stow mechanism as described below.

As shown in FIG. 2, top plate 4, bushing 12, and middle plate 13 each include a second hole for receiving a shaft of locking pin assembly 9 (i.e., a hole second to the hole for receiving bolt 15). In some cases, middle plate 13 may include a retainer in its second hole for receiving the shaft of locking pin assembly 9, but in other embodiments the retainer may be omitted from middle plate 13. In any case, locking pin assembly 9 is configured such that a portion of it is affixed within the referenced second hole of top plate 4, but the shaft is vertically moveable through the affixed portion and, thus, is vertically moveable through the second holes of each of top plate 4, bushing 12, and middle plate 13. In particular, locking pin assembly 9 is configured to move the shaft upward to remove it from the respective holes of bushing 12 and middle plate 13, but keep a portion of the shaft within the respective hole of top plate 4. As a result, a portion of the shaft and the accompanying knob of locking pin assembly 9 is displaced upward when activated.

Figure 8:
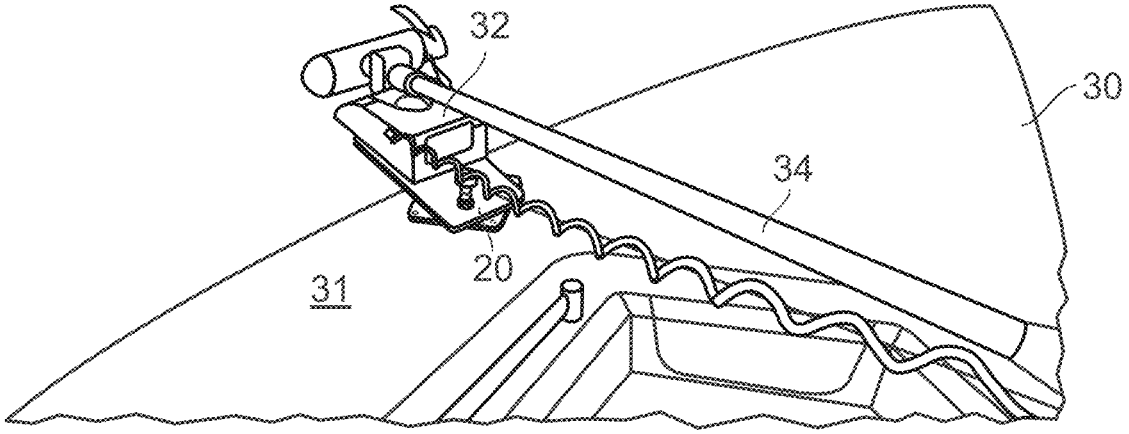
FIG. 8 illustrates trolling motor depicted in FIG. 7 being moved away from the top deck of the boat across the deck of the boat.

In some embodiments, bushing 12 and middle plate 13 may only include one hole for receiving the shaft of locking pin assembly 9 as shown in FIG. 2. In such cases, swivel mount 20 may be mounted on a surface in a specific orientation such that the shaft of locking pin assembly 9 secures middle plate 13 in a position that suspends an object mounted thereto in a particular location relative to the mounting surface of swivel mount 20. For instance, in embodiments in which a trolling motor is attached to swivel mount 20, swivel mount 20 may be mounted on a gunnel of a boat in a specific orientation such that the shaft of locking pin assembly 9 secures middle plate 13 in a position that suspends the trolling motor outside of the boat. An example orientation of swivel mount 20 arranged in such a manner is shown in FIG. 8 and is described in more detail below. In such cases, it may not be necessary for bushing 12 and middle plate 13 to have an additional hole to secure the trolling motor in a position over the gunnel surface (i.e., to secure top plate 4 in a different position relative to middle plate 13), particularly when the trolling motor is pulled out of the water and stored above the gunnel since the gunnel may include a trolling motor shaft clamp to secure the trolling motor in place.

Figure 4:
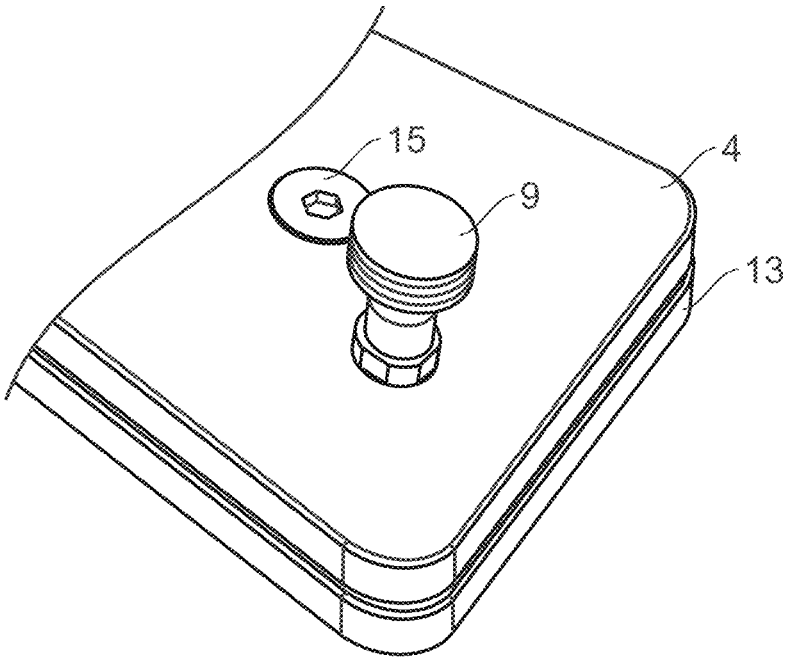
FIG. 4 illustrates a perspective view of an end portion of the swivel mount depicted in FIG. 1.
Figure 5:
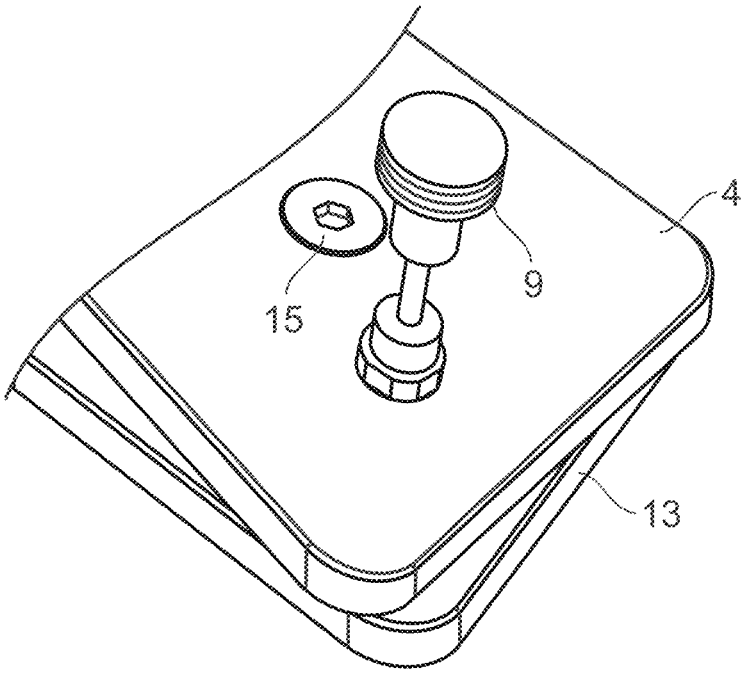
FIG. 5 illustrates a perspective view of the end portion of the swivel mount depicted in FIG. 4 with the top plate of the swivel mount rotates relative to its middle plate.

FIGS. 4 and 5 depict the end portion of swivel mount 20 (referenced as first portion 26 in FIG. 1 and in more detail below) for embodiments in which bushing 12 and middle plate 13 only include one hole for receiving the shaft of locking pin assembly 9. More specifically, FIGS. 4 and 5 depict portion 26 of swivel mount 20 with locking pin assembly 9 in respectively different positions (i.e., recessed and retracted) based on the position of top plate 4 relative to middle plate 13. In particular, when top plate 4 and middle plate 13 are in alignment, the shaft of pull pin assembly 9 fits into the referenced second holes of top plate 4, bushing 12, and middle plate 13 and, thus, pull pin assembly 9 will be in a recessed position as shown in FIG. 4. In contrast, when the shaft of locking pin assembly 9 is shifted upward to swivel top plate 4 relative to middle plate 13, the shaft will be withdrawn from the referenced second holes of bushing 12 and middle plate 13 and will remain in a retracted position as shown in FIG. 5 since bushing 12 and middle plate 13 do not have additional holes to accommodate the shaft of locking pin assembly 9.

It is noted that the positions of the referenced second holes of bushing 12 and middle plate 13 do not necessarily need to align with the referenced second hole of top plate 4 when top plate 4 is aligned with middle plate 13. In particular, swivel mount 20 may be alternatively configured to secure the shaft of locking pin assembly 9 into the referenced second holes of bushing 12 and middle plate 13 when top plate 4 is not aligned with middle plate. As such, the different positions of locking pin assembly 9 depicted in FIGS. 4 and 5 (i.e., recessed and retracted) may, in some cases, may be reversed. In particular, when top plate 4 and middle plate 13 are in alignment, pull pin assembly 9 may be in a retracted position and when top plate 4 and middle plate 13 are not in alignment, pull pin assembly 9 may be in a seated position (i.e., if the top plate is positioned such that all three of the referenced second holes are in alignment).

In other embodiments, bushing 12 and, in some cases, middle plate 13 may include multiple holes in proximity to their perimeters for securing the shaft of locking pin assembly 9, enabling top plate 4 to be secured at different positions relative to middle plate 13. It is noted that although middle plate 13 may include multiple holes for securing the shaft of locking pin assembly 9, additional holes may weaken the integrity of middle plate 13 affecting the strength of swivel mount 20 to counteract applied forces against it. Bushing 12 includes a material that permits the rotational movement of top plate 4 relative to middle plate 13, such as but not limited to polytetrafluoroethylene (PTFE), but does not substantially counteract forces applied against swivel mount 20. Consequently, the inclusion of additional holes in bushing 12 will not affect the strength of swivel mount 20. As such, in some cases, bushing 12 may include multiple holes in proximity to its perimeter for securing the shaft of locking pin assembly 9 while middle plate 13 may only include a single hole for securing the shaft of locking pin assembly 9.

In general, bearing 7 of swivel mount 20 allows the entirety of bolt 15 to swivel with top plate 4. Bearing 7 may be any type of bearing to allow such movement, such as but not limited to a thrust ball bearing. A benefit of the design of swivel mount 20 is that bolt 15 may be the only bolt in the swivel element of the mount. In particular, the use of a single bolt limits the number of holes to be made in the surface to which swivel mount 20 is to be attached, such as to the gunnel of a boat, reducing the amount of alteration and potential damage to the mounting surface. In general, the combination of bolt 15, bearing 7 and nut 8 serves as a swivel element of the swivel mount. More specifically, the combination of bolt 15, bearing 7 and nut 8 serves to provide swivel (i.e. rotational) movement of top plate 4 about the shaft of bolt 15. Given the orientation of bolt 15 relative to top plate 4, the combination of bolt 15, bearing 7 and nut 8 serves to also provide swivel (i.e. rotational) movement of top plate 4 about an axis perpendicular to and passing through primary faces of top plate 4. Furthermore, the combination of bolt 15 and nut 8 serves to couple top plate 4, middle plate 13, and lower plate 6 together such that their primary faces are parallel, and they at least partially overlap. With such a configuration, swivel mount 20 is configured to provide swivel movement of top plate 4 in a plane parallel with the primary faces of middle plate 13 and further the surface to which it is mounted, such as a gunnel of a boat.

As shown in FIGS. 1 and 2, top plate 4 includes first portion 26 (illustrated as the right-hand portion in the figures) in which bolt 15 and pull pin assembly 9 is mounted and to which bushing 12, middle plate 13, bottom plate 13, bushing 7 and nut 8 are aligned. In addition, top plate 4 includes second portion 28 (illustrated as the left-hand portion in the figures) extending from first portion 26. In general, second portion 28 of top plate 4 is configured to receive and secure an object to swivel mount 20 and, thus, top plate 4 may serve as a mounting member of swivel mount 20. In some cases, as shown in FIGS. 1 and 2, second portion 28 of top plate 4 may include a plurality of through holes 29 for receiving a plurality of bolts or screws to secure an object to top plate 4. As set forth in detail below, an object may be attached to a topside surface of top plate 4 (i.e., the surface of top plate 4 from which locking pin 9 extends) via plurality of through hole 29. Although it may not be conducive for an application of mounting a trolling motor over a boat gunnel, it is possible in other applications for an object to be mounted to the underside surface of top plate 4 (i.e., the surface of top plate 4 cantilevered and adjacent to bushing 12 and middle plate 13) via plurality of through holes 29 if the object does not interfere with the mounting surface to which swivel mount 20 is affixed when it is swiveled.

As further described below in reference to FIGS. 13-15, the number and arrangement of through holes 29 in top plate 4 may vary depending on the object which will be mounted to the swivel mount and, in some cases, may be configured to accommodate a plurality of different types of objects or different models of the same type of object. For example, the number and arrangement of through holes 29 may be configured to accommodate different models of trolling motors or different models of trolling motor mount brackets. FIGS. 1 and 2 illustrate an example layout of through holes 29 which may serve such a purpose, but other arrangements may be considered to achieve such an objective as described in reference to FIGS. 14 and 15. In other embodiments, second portion 28 of top plate 4 may include an arrangement of through holes which are specific to mounting a particular make and model of a trolling motor or a particular make and model of a trolling motor mounting bracket. In yet other cases, through holes 22 may be omitted from top plate 4 and, instead, second portion 28 of top plate 4 may include a sliding track for slidingly receiving an object on top plate 4, such as a sliding track for receiving a trolling motor or a trolling motor mount bracket to the swivel mount. In some cases, the sliding track may be configured to secure an object thereto, such as via a locking latch for example. In other cases, swivel mount 20 may include a separate component for securing an object on to the sliding track. In any case, the configuration of top plate 4 to have the aforementioned distinct first and second portions enables an object as a whole to be laterally arranged a set distance from a pivot point of swivel mount 20 and, thus, swivel mount 20 has an offset pivot point.

In general, the size of top plate 4, middle plate 13 and lower plate 6 may vary depending on the application in which swivel mount is to be used. For example, for applications of securing a boating accessory above a gunnel, lower plate 6 may be sized to fit to an underside surface of the gunnel. Although middle plate 13 may not be restricted to the size of an upper surface of a gunnel, it is generally not favorable to have any item, much less a mounting plate jutting out into a deck area of a boat. Furthermore, it is generally not appealing to have an item, much less a mounting plate jutting out from the exterior of a boat. As such, for such reasons, it may be advantageous to limit the size, particularly the width, of middle plate 13 to fit on an upper surface of a gunnel without extending past its edges. An exemplary width range for middle plate 13 may be between approximately 4 inches and approximately 12 inches and, more specifically, between approximately 6 inches and approximately 10 inches, but larger and smaller widths may be considered depending on the size of the gunnel to which swivel mount may be affixed. Although a greater range of lengths that may be considered for middle plate 13, it is generally advantageous to limit the number of holes drilled into a surface of a boat, including its gunnel. As such, it may be advantageous to limit the length of middle plate 13 to be 75% to 125% the width of the plate. As shown in FIGS. 1 and 2, middle plate 13 and lower plate 6 may, in some embodiments, be square, but other shapes may be considered, such as but not limited to being circular, rectangular, or elliptical.

In contrast to middle plate 13 and lower plate 6, top plate 4 is sized to jut out from the surface to which swivel mount 20 is affixed. As such, at least the length of top plate 4 is not restricted to the surface area to which swivel mount is affixed. However, for an application in which swivel mount 20 is used to maneuver a trolling mount assembly over a boat's gunnel to the exterior of the boat's hull, it may be favorable to limit the width of top plate 4 to fit on the upper surface of the gunnel without extending past its edges. As a result, in some cases, top plate 4 may be elongated (meaning it has a longer length dimension than a width dimension). Furthermore, in light of the noted size restrictions of middle plate 13, particularly for applications in which swivel mount 20 is to be affixed to a boat gunnel, top plate 4 may have a longer length than middle plate 13 and, in some cases, may be twice as long or more. Alternatively stated, in some cases, middle plate 13 may have a length less than or equal to half the length of top plate 4 as is depicted in FIGS. 1 and 2. As a result, portion 28 of top plate 4 may be cantilevered from the coupling of portion 26.

In general, the length of top plate 4 may vary depending on the distance or area to which an object mounted thereon is to be moved via swivel mount 20. In general, it is advisable to extend a trolling mount assembly at least 14 inches past a boat's gunnel in order to make sure the trolling motor does not come into contact with the exterior of the boat's hull. Given that trolling motor brackets are generally designed to suspend trolling motors from its end by a couple of inches, it would be advantageous for portion 28 of top plate 4 to be greater than 10 inches and, preferably 12 inches or more. It is also advisable to limit the distance a trolling motor is extended past a boat's gunnel since the farther a trolling motor is extended from a boat the more susceptible it will be to damage caused by forces incurred during boating, particularly in an offshore environment. For instance, it may be advantageous for the length of portion 28 of top plate 4 to be less than 20 inches and, preferably less than 18 inches. Coupling such length ranges with the size range noted for middle plate 13 (which may or may not be the same size as portion 26 of top plate 4), an exemplary length range for top plate 4 may between approximately 12 inches and approximately 30 inches, and more specifically, between approximately 14 inches and approximately 20 inches.

The thickness of top plate 4, middle plate 13, and lower plate 6 may vary depending on the application in which swivel mount is to be used and, in regard to top plate 4 and middle plate 13, may depend on the height to mount an object above a mounting surface to which middle plate 13 is affixed. In addition, the thickness of top plate 4, middle plate 13, and lower plate 6 may depend on the material used for the plates. An example thickness range for top plate 4, middle plate 13, and lower plate 6 may be between approximately 0.15 inches and approximately 1.0 inch, but larger and smaller thicknesses may be considered. The material used for top plate 4, middle plate 13, and lower plate 6 may be the same or may be different, but in either case the material used for top plate 4, middle plate 13, and lower plate 6 may generally depend on the application in which swivel mount is to be used. For example, for applications of mounting accessories to a boat, top plate 4, middle plate 13, and lower plate 6 may include a material that is resistant to marine corrosion. Furthermore, for applications in which a trolling motor is mounted over a gunnel a boat, top plate 4, middle plate 13, and lower plate 6 may include a material strong and thick enough to tolerate the forces exerted against the accessory during operation of the accessory or the boat, particularly for applications of offshore boating. Example materials for such applications include but are not limited to 7075-T6 precipitation-hardened aluminum alloy due to its high strength to weight ratio.

Figure 6:
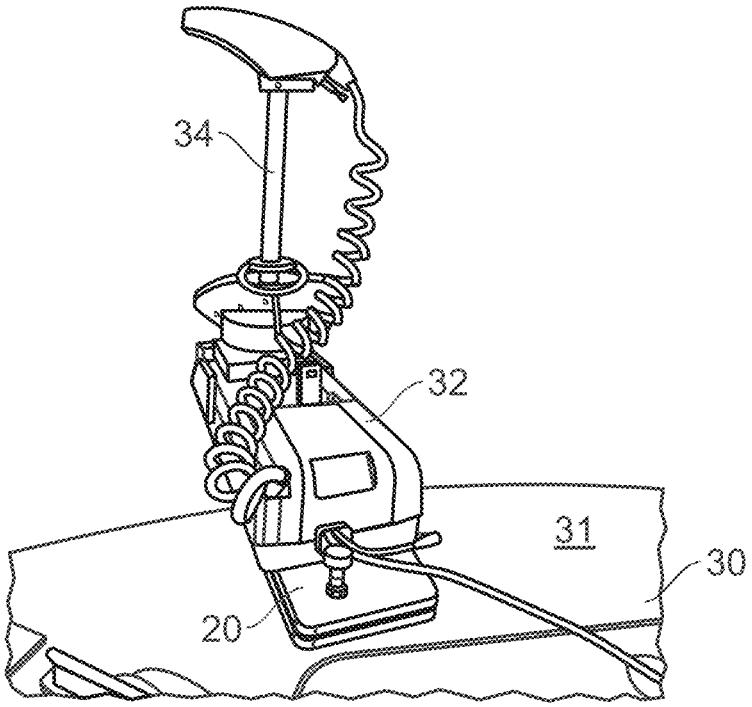
FIG. 6 illustrates a trolling motor suspended exterior to a boat's hull via the swivel mount depicted in FIG. 1 mounted to the boat's gunnel.
Figure 7:
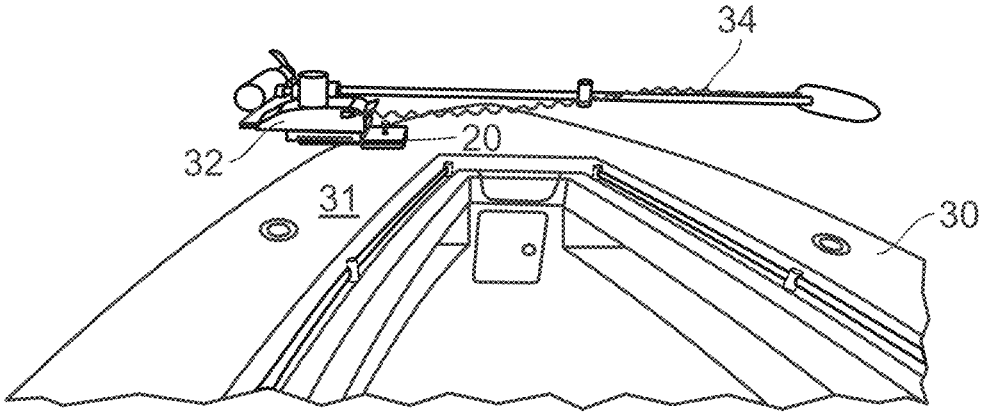
FIG. 7 illustrates the trolling motor depicted in FIG. 6 pulled over the top deck of the boat.
Figure 9:
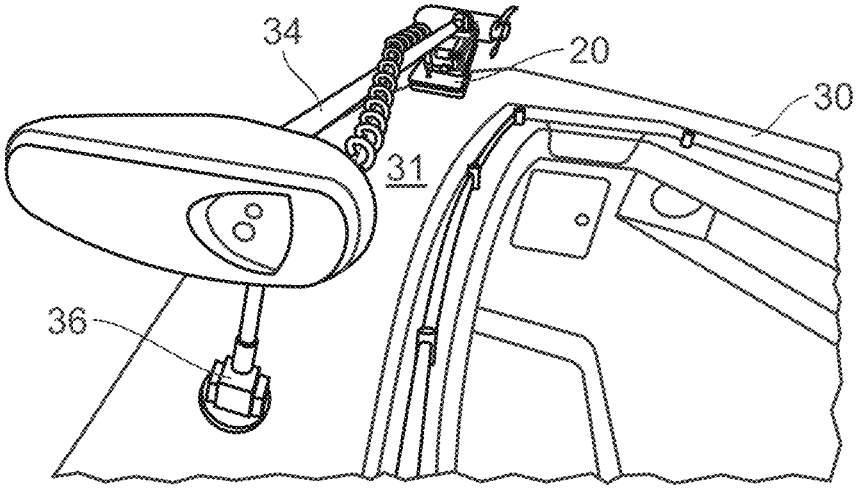
FIG. 9 illustrates trolling motor depicted in FIG. 8 moved to be in alignment with the boat's gunnel.
Figure 10:
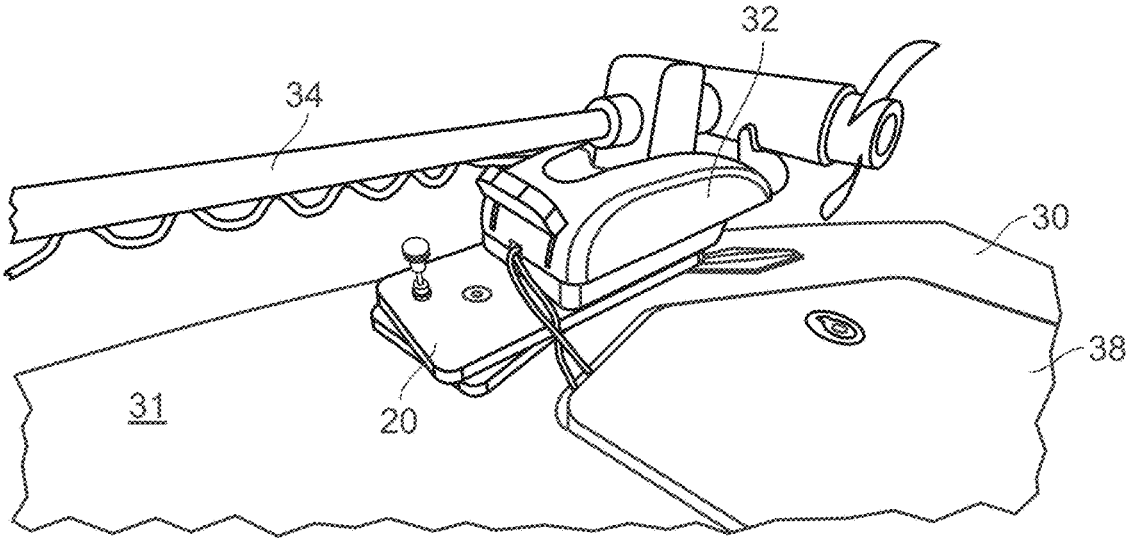
FIG. 10 illustrates a closeup view of the propeller end of the trolling motor depicted in FIG. 9.

An example of using swivel mount 20 to support and maneuver a trolling motor over a boat gunnel is shown in FIGS. 6-10. In particular, FIG. 6 illustrates trolling motor 34 suspended outside of boat 30 by trolling motor deploy/stow bracket 32, which is coupled to the upper surface of swivel mount 20 on an upward facing surface of gunnel 31 near the bow of the boat. FIG. 7 illustrates trolling motor 34 in a position across the top deck portion of boat 30 after being pulled from its position over gunnel 31. FIG. 8 illustrates trolling motor 34 in a position across the deck of boat 30 after locking pin assembly 9 of swivel mount 20 has been activated and while the trolling motor 34 is being moved via the swivel movement of top plate 4 of swivel mount 20. FIG. 9 illustrates trolling motor 34 in alignment with gunnel 31 in a direction extended from the bow of the boat after its movement to such a stowed position via the swivel movement of top plate 4 of swivel mount 20. In such an embodiment, trolling motor 34 is secured in such the stowed position by trolling motor shaft clamp 36 coupled to gunnel 31. It is noted that such a stowed position is advantageous in that trolling motor 34 does obstruct areas of the boat deck nor does it obstruct access anchor locker 38 as shown in FIG. 10. In particular, FIG. 10 is a close-up view of trolling motor 34 in its stowed position of FIG. 9, particularly showing mount 20, trolling motor deploy/stow bracket 32 as well as the shaft and propeller end of trolling motor 34 displaced from access anchor locker 38. Moreover, FIG. 10 illustrates top plate 4 of swivel mount 20 out of alignment with middle plate 13 and with locking pin assembly 9 in a retracted position such as described in reference to FIG. 5.

Figure 11:
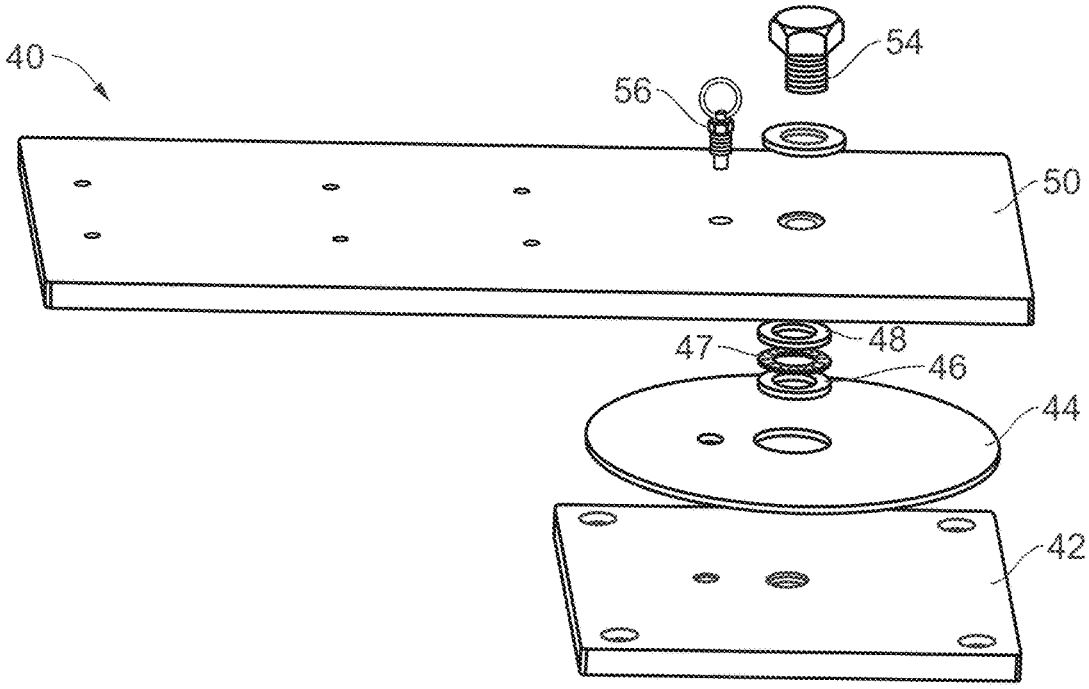
FIG. 11 illustrates an exploded view of another example of a swivel mount.

FIGS. 11 and 12 illustrate other examples of swivel mounts which may be used to mount accessories, such as but not limited to trolling motors, on to and over a gunnel of a boat or any other mounting surfaces. The swivel mount 40 depicted in FIG. 11 differs from swivel mount 20 depicted in FIGS. 1-10 in that it does not include a middle plate and the locking pin assembly 56 is in a different position relative to bolt 54. In addition, swivel mount 40 includes bearing 47 disposed between washers 46 and 48 and more generally between top plate 50 and bushing 44. Although not shown, swivel mount 40 includes a nut for securing base plate 42 against a mounting surface with top plate 50, bearing 47 and bushing 44 compiled above it. Similar to middle plate 13 of swivel mount 20 discussed in reference to FIGS. 1-10, base plate 42 may include corner holes for further affixing it to a mounting surface. In addition to what is shown, swivel mount 40 may, in some embodiments, include a reinforcement plate for coupling to base plate 42 along an underside of a mounting surface, such as a gunnel of a boat. In any case, bolt 54 and bearing 47 serve as a swivel element for swivel mount 40, particularly providing swivel (i.e. rotational) movement of top plate 50 about the shaft of bolt 54. With such a configuration, swivel mount 40 is configured to provide swivel movement of top plate 50 in a plane parallel with the primary faces of base plate 42 and further the surface to which it is mounted, such as a gunnel of a boat.

As shown in FIG. 11, top plate 50 may include a plurality of through holes in its cantilevered portion for mounting an object. Similar to top plate 4 of swivel mount 20 described in reference to FIGS. 1 and 2, the number and arrangement of through holes in top plate 50 may vary depending on the object which will be mounted to the swivel mount and, in some cases, may be configured to accommodate a plurality of different types of objects or different models of the same type of object. Top plate 50 may include the same number and arrangement of through holes as top plate 4 of swivel mount 20 or may be different as shown in FIG. 11. Plates having other quantities and arrangement of through holes that may be considered for top plate 50 are shown and described in reference to FIGS. 13-15.

The swivel mount 60 depicted in FIG. 12 differs from swivel mounts depicted in FIGS. 1-11 in that it does not include a central bolt for its swivel element. Rather, swivel mount 60 includes swivel element 64 disposed on or within base plate 62. In general, swivel element 64 includes an annular bearing to provide swivel (rotational) movement of swivel element 64 relative to base plate 62. Via its coupling to top plate 66 (such as via the four screws shown in FIG. 12), swivel element 64 provides swivel (rotational) movement of top plate 66 relative to base plate 62 and, in particular about an axis that is perpendicular and passing through the primary faces of top plate 50 at a point spaced from a widthwise center lines of the plate. In other words, swivel element 64 provides swivel (rotational) movement of top plate 66 in a plane parallel to the upper surface of base plate 62. As shown in FIG. 12, top plate 66 is elongated, offering an extended platform on which to secure an object, such as but not limited to a trolling motor mounting bracket. Another difference of swivel mount 60 from swivel mounts 20 and 40 is that swivel mount 60 includes a horizontal locking pin assembly. In other embodiments, however, swivel mount 60 may be modified to include a vertical pull pin assembly such as described in reference to FIGS. 1-11. Similar to middle plate 13 of swivel mount 20 discussed in reference to FIGS. 1-10, base plate 62 may include corner holes for further affixing it to a mounting surface, such as but not limited to a boat gunnel. In addition to what is shown, swivel mount 60 may, in some embodiments, include a reinforcement plate for coupling to base plate 62 along an underside of a mounting surface, such as a boat gunnel.

Similar to top plate 4 of swivel mount 20 and top plate 50 of swivel 40, top plate 66 of swivel mount 60 may include a plurality of through holes in its cantilevered portion for mounting an object. In general, the number and arrangement of through holes in top plate 66 may vary depending on the object which will be mounted to the swivel mount and, in some cases, may be configured to accommodate a plurality of different types of objects or different models of the same type of object. In some cases, top plate 66 may include the same number and arrangement of through holes as top plate 4 of swivel mount 20 or top plate 50 of swivel mount 40. Alternatively, top plate 66 may be different number and arrangement of through holes as shown in FIG. 12. Plates having other quantities and arrangement of through holes that may be considered for top plate 66 are shown and described in reference to FIGS. 13 and 14.

As noted above in reference to swivel mount 20 described in reference to FIGS. 1 and 2, the number and arrangement of through holes 29 in top plate 4 may be configured to accommodate different models of trolling motor mount brackets. Top plate 4 of swivel mount 20 and top plate 50 of swivel mount 40 illustrate examples of through-hole arrangements which may be used for such a purpose. FIGS. 13-15 illustrate mounting brackets having other through-hole arrangements which may be considered as well for the mount members of the swivel mounts disclosed herein.

Figure 13:
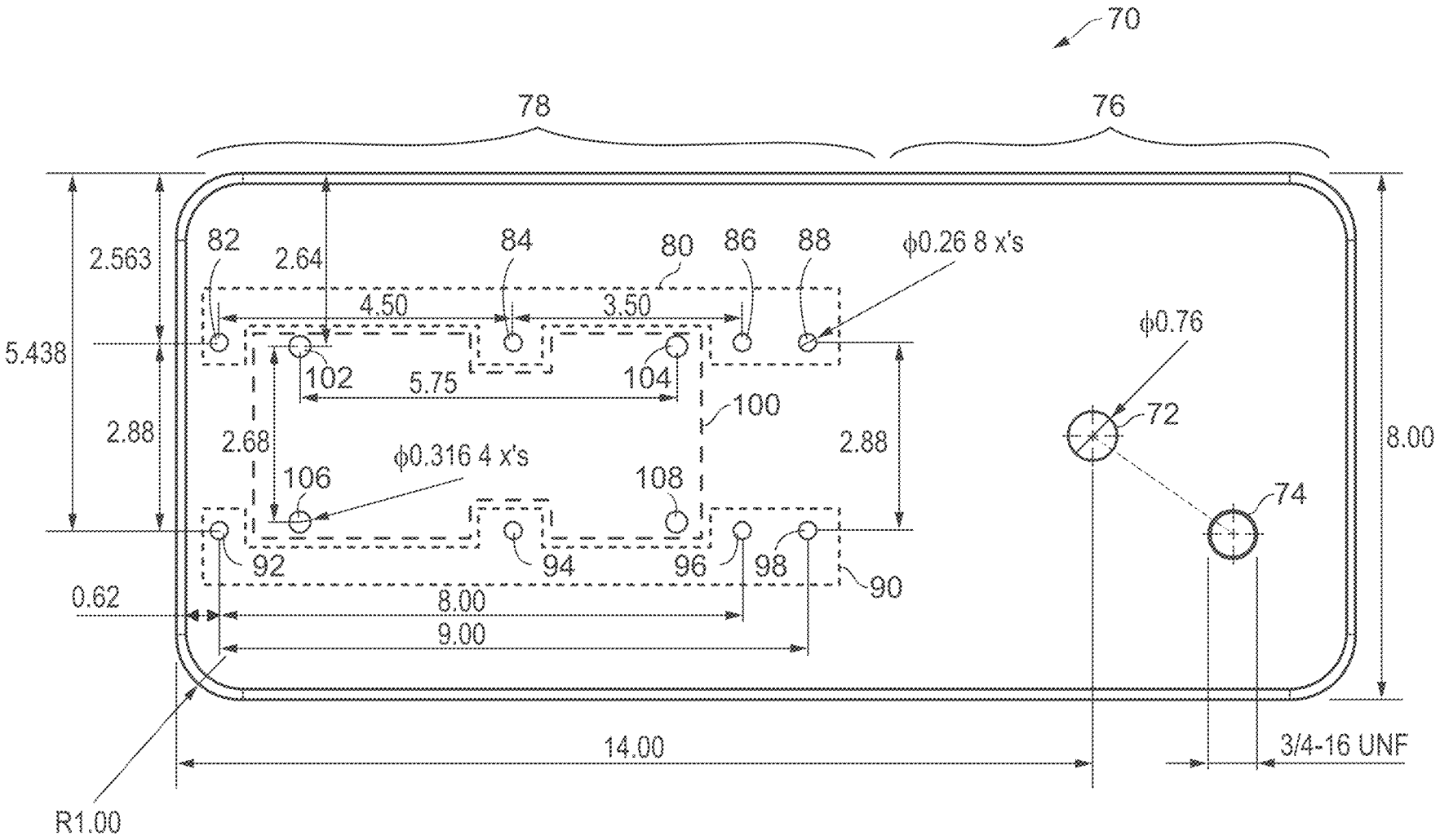
FIG. 13 illustrates a top view of an example mounting bracket for the swivel mounts disclosed herein.

Turning to FIG. 13, a top view of plate 70 is shown having one its primary faces facing upward and having a plurality of through holes extending through to the plates opposing primary face. The length of the plate is 18 inches and the width of plate 70 is 8 inches, but larger or smaller outer peripheral dimensions may be considered as they do not generally affect the mounting of a trolling motor mounting bracket. Plate 70 is configured to be a top plate for a swivel mount comprising a bolt, bushing, and bearing as its swivel element, such as discussed for swivel mounts 20 and 40 in reference to FIGS. 1 and 11, respectively. As such, plate 70 includes through hole 72 for accommodating a bolt of a swivel element. In addition, plate is configured to have a vertical locking pin assembly, such as discussed for swivel mounts 20 and 40 in reference to FIGS. 1 and 11, respectively. As such, plate 70 includes through hole 74 for accommodating a locking pin assembly. It is noted, however, that plate 70 may alternatively include a horizontal locking pin assembly extending from a sidewall of plate 70 and/or plate 70 may be configured for mounting to a swivel disc such as swivel element 64 shown and described in reference to FIG. 12. As such, either or both of through holes 72 and 74 may be omitted from plate 70. In some cases, plate 70 may include other through holes for coupling the right hand side of plate 70 to a swivel disc.

Regardless of the number and arrangement of through holes in portion 76 of plate 70, portion 78 may include the specific number and arrangement of through holes shown in FIG. 13 to accommodate different models and manufacturers of trolling motor mount brackets. In particular, the specific number and arrangement of through holes in portion 78 of plate 70 are configured to accommodate quick release pucks or inner plates for the Force® Kracken trolling motor available from Garmin®, the Move PV trolling motor available from Power Pole, the RTA quick release inner plates available from Minn Kota®, and 4 bolt pucks and 6 bolt pucks available from Rhodan. The benefit of being able to accommodate so many different models and manufacturers of trolling motor mount brackets is that the swivel mount to which plate 70 may be universally used and, in turn, the complexity of matching a swivel mount for a particular trolling motor may be minimized. In addition, the variation of a product line of swivel mounts may be minimized, allowing production costs to be lower and processing orders to be simpler. The through holes in portion 78 of plate 70 are described below with respective to different sets of holes and the spacing of the holes in each set as well as the placement of one set relative to another. The different sets of holes are outlined by dotted lines in FIG. 13, but the dotted lines are not part of plate 70. Rather, the dotted lines are merely used to describe the arrangement of through holes in portion 78 of plate 70.

As shown in FIG. 13, the through holes in portion 78 of plate 70 include a first set of four holes 80 of the same size in linear alignment with each other along a length of the plate. In particular, first set of four holes 80 includes through holes 82, 84, 86 and 88 each having a diameter of 0.26 inches and each having a center point spaced from the same peripheral edge of plate 70 by 2.564 inches. Further to such holes, portion 78 of plate 70 include a second set of four holes 90 of the same size as holes 82, 84, 86 and 88 and in linear alignment with each other along a length of the plate. In particular, second set of four holes 90 includes through holes 92, 94, 96 and 98 each having a diameter of 0.26 inches and each having a center point spaced from the same peripheral edge of plate 70 by 5.438 inches. The arrangement of the individual holes of the first and second sets of four holes 80 and 90 along the length of plate 70 is such that the each of the second set of four holes 90 is in respective alignment with a different hole of the first set of four holes 80 as taken along the width of the plate. In particular, holes 92, 94, 96 and 98 are in respective alignment with each of holes 82, 84, 86 and 88 as taken along the width of plate 70. Since both first and second sets of holes 80 and 90 are in linear alignment with each other along the length of plate 70, holes 92, 94, 96 and 98 are respectively spaced from holes 82, 84, 86 and 88 by the same distance, namely having 2.88 inches between the center points of the each of the corresponding holes of the two sets as shown in FIG. 13.

As further shown in FIG. 13, holes 82 and 92 are disposed closest to an end of plate 70 among the holes of their respective sets, particularly each having their center points 0.62 inches from the edge of the plate. Furthermore, each of holes 84 and 94 are shown having a center point respectively disposed 4.5 inches from a center point of holes 82 and 92 in a direction away from the noted end of the plate. Moreover, each of holes 86 and 96 have a center point respectively disposed 3.5 inches from the center point of holes 84 and 94 in a direction away from the noted end of the plate. Lastly, each of holes 88 and 98 have a center point respectively disposed 1.0 inch from the center point of holes 86 and 96 in a direction away from the end of the plate. The specific arrangement and size of the first and second holes accommodate the quick release pucks or inner plates of the Move PV trolling motor available from Power Pole, the RTA quick release inner plates available from Minn Kota®, and 4 bolt pucks and 6 bolt pucks available from Rhodan. More specifically, holes 82, 88, 92 and 98 accommodate the quick release pucks or inner plates of Move PV trolling motor available from Power Pole and the RTA quick release inner plates available from Minn Kota®, while holes 82, 84, 86, 92, 94 and 96 accommodate 4 bolt pucks and 6 bolt pucks available from Rhodan.

To accommodate inner plates for the Force® Kracken trolling motor available from Garmin®, plate 70 includes a third set of four holes 100 of the same size as each other but larger size than the first and second sets of four holes 80 and 90. In particular, plate 70 includes holes 102, 104, 106 and 108 each having a diameter of 0.316 inches. Moreover, holes 102, 104, 106 and 108 are disposed within an area of plate 70 bounded by the first and second sets of four holes 80 and 90. In particular, set of four holes 100 is arranged between set of four holes 80 and set of four holes 90. As shown in FIG. 13, holes 102 and 104 have their center points 5.75 inches apart and linearly aligned parallel with the first set of four holes 80. In addition, holes 106 and 108 are arranged in respective alignment with holes 102 and 104 as taken along the width of plate 70, wherein each of the second set of two holes has a center point spaced 2.68 inches from a center point of its respective different hole of the first set of two holes. Since holes 102 and 104 as well as holes 106 and 108 are in linear alignment with each other along the length of plate 70, holes 102 and 104 are respectively spaced from holes 106 and 108 the same distance, namely having 2.68 inches between the center points of the each of the corresponding holes as shown in FIG. 13.

Figure 14:
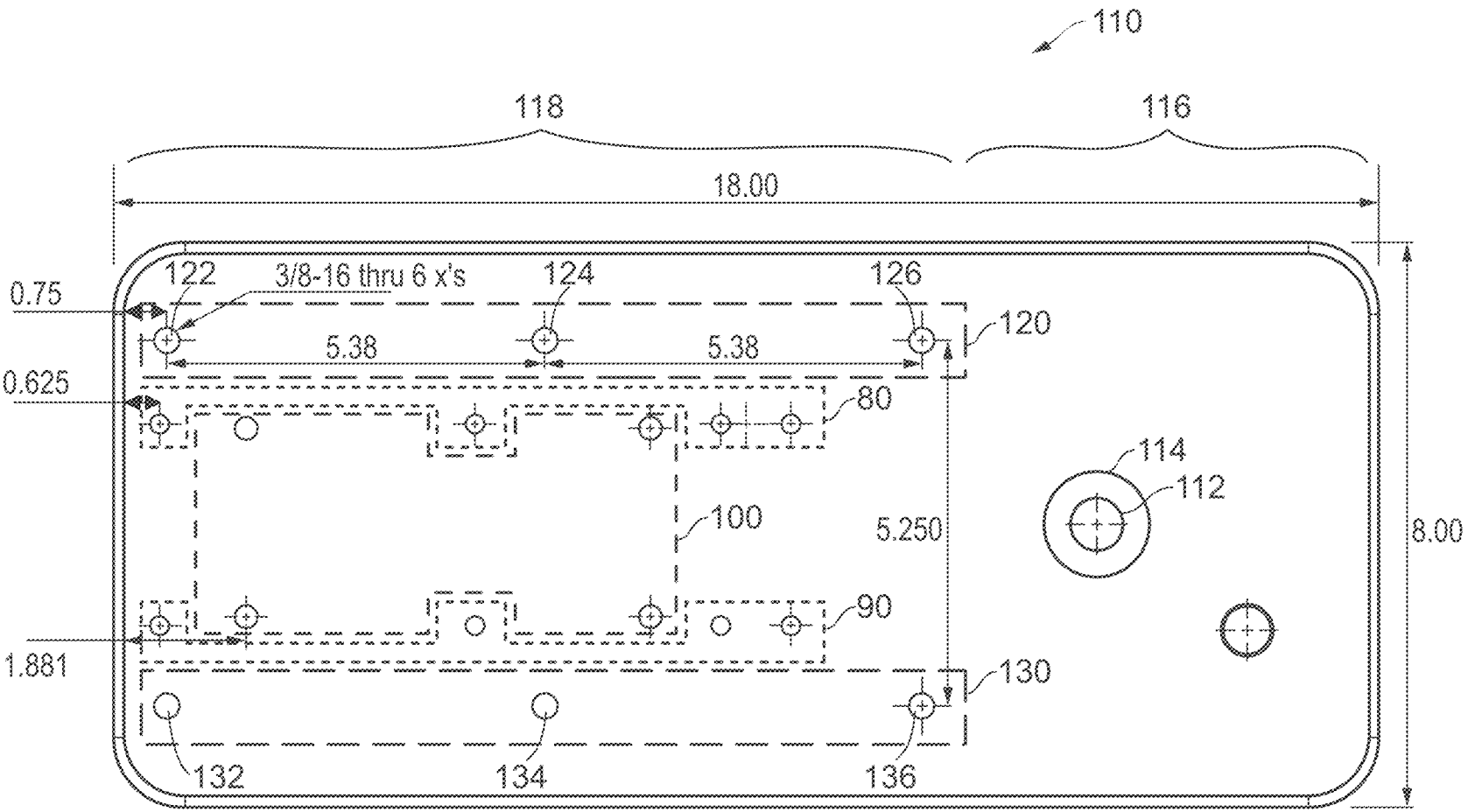
FIG. 14 illustrates a top view of another example of a mounting bracket for the swivel mounts disclosed herein.

In order to accommodate quick release pucks or inner plates of the Quest series of trolling motor available from Minn Kota® in addition to the trolling motor brackets noted for plate 70, plate 110 shown in FIG. 14 was developed. As shown, portion 118 of plate 110 includes sets of four holes 80, 90 and 100 as described in reference to plate 70 in FIG. 13. The description of size and placement of the holes in such sets are referenced from FIG. 13 but are not reiterated for the sake of brevity. In addition to such sets of holes, portion 118 of plate 110 includes a set of three holes 120 and a set of three holes 130, making up a set of six holes of the same size as each other but larger size than the first and second sets of four holes 80 and 90. In particular, plate 110 includes holes 122, 124, 126, 132, 134 and 136 each having a diameter of 0.375 inches. As shown in FIG. 14, holes 122, 124, 126, 132, 134 and 136 are disposed outside an area of the plate bounded by the first and second sets of four holes 80 and 90. As further shown in FIG. 14, holes 122, 124 and 126 have their center points 5.38 inches apart and linearly aligned parallel with the first set of four holes 80. Moreover, holes 132, 134 and 136 are in respective alignment with holes 122, 124 and 126 as taken along the width of the plate. In addition, holes 132, 134 and 136 respectively have a center point spaced 5.25 inches from a center point of holes 122, 124 and 126 as taken along the width of the plate.

It is noted that portion 116 of plate 110 may have the same options of holes as described for portion 76 of plate 70 in FIG. 13. The description of such options is referenced from FIG. 13 but are not reiterated for the sake of brevity. It is noted that when portion 116 includes hole 112 for accommodating a bolt used to provide rotation in a swivel element along with an accompanying bearing, portion 116 may optionally include indentation 114 around hole 112 for accompanying a head of a flat head bolt. The indentation may be beneficial for having the bolt head flush with the upper surface of plate 110, which may be beneficial for accommodating some trolling motor brackets that may extend into portion 116 of plate 110. Such a feature may be included in any of the mounting members of the swivel mounts disclosed herein and, thus, is not exclusive to plate 110 in FIG. 14. In particular, such an indentation feature may be included in top plate 4, top plate 50 or top plate 60 respectively described in reference to FIGS. 1, 11 and 12. In addition, an indentation feature may be included in plate 140 described in reference to FIG. 15 below.

Figure 15:
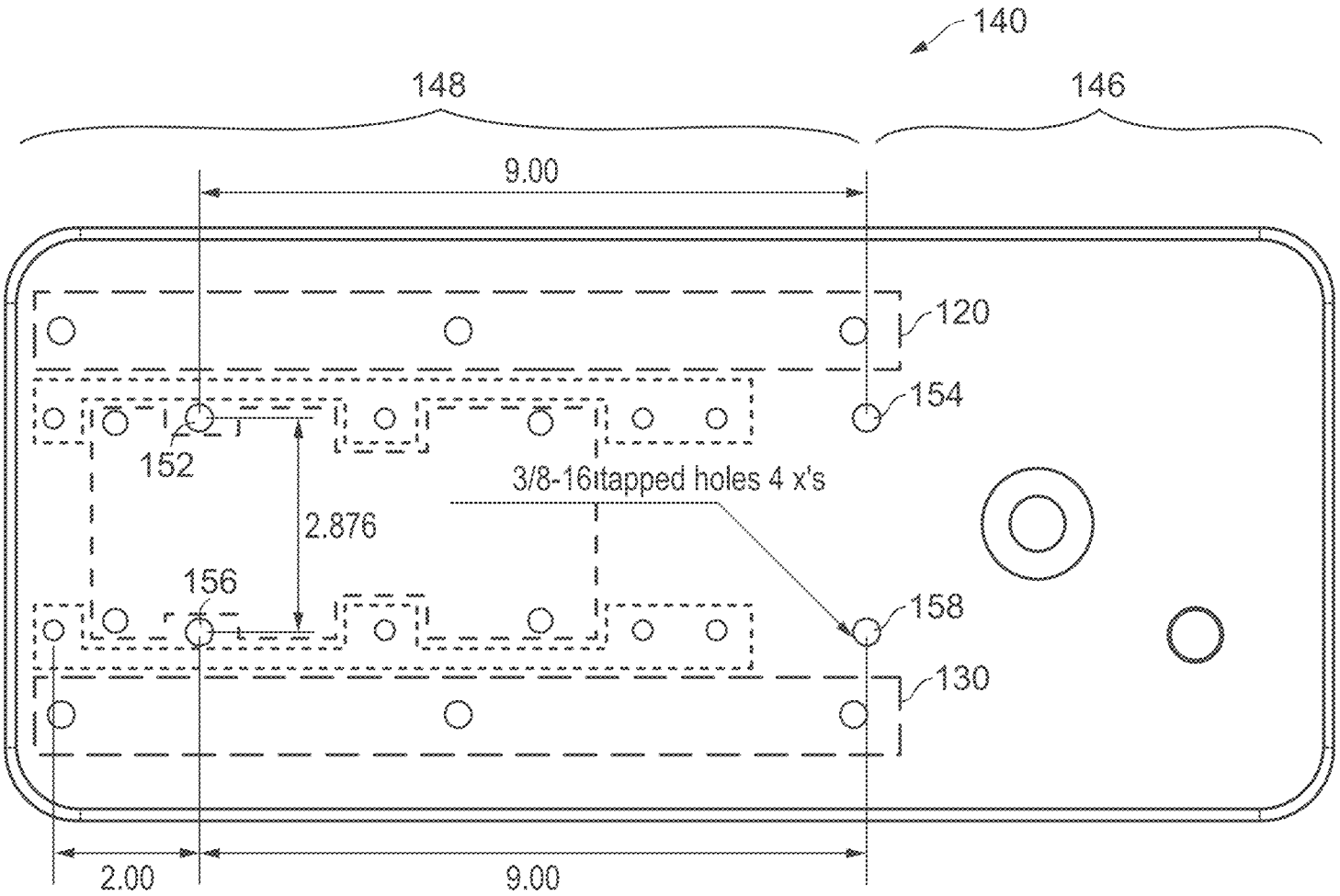
FIG. 15 illustrates a top view of yet another example of a mounting bracket for the swivel mounts disclosed herein.

In order to accommodate quick release pucks or inner plates of Move Offshore trolling motor available from Power Pole in addition to the trolling motor brackets noted for plates 70 and 110, plate 140 shown in FIG. 15 was developed. As shown, portion 148 of plate 140 includes sets of four holes 80, 90 and 100 as described in reference to plate 70 in FIG. 13 as well as sets of three holes 120 and 130 as described in reference to plate 110 in FIG. 14. The descriptions of size and placement of the holes in such sets are referenced from FIGS. 13 and 14 but are not reiterated for the sake of brevity. In addition to such sets of holes, portion 148 of plate 140 includes holes 152, 154, 156 and 158 of the same size as each other but larger size than the first and second sets of four holes 80 and 90. In particular, holes 152, 154, 156 and 158 each have a diameter of 0.375 inches. As shown in FIG. 15, holes 152 and 154 have their center points 9.00 inches apart and linearly aligned parallel with the first set of four holes 80. Moreover, holes 152 and 154 are in respective alignment with holes 156 and 158 as taken along the width of the plate. In addition, holes 152 and 154 respectively have a center point spaced 2.876 inches from a center point of holes 158 and 158 as taken along the width of the plate.

It is noted that portion 146 of plate 140 may have the same options of holes as described for portion 116 of plate 110 in FIG. 14. The description of such options is referenced from FIG. 14 but are not reiterated for the sake of brevity. Furthermore, it is noted that the mounting members of the swivel mounts disclosed herein are not restricted to the combination of holes disclosed for each of the plates described in reference to FIGS. 13-15 or shown in FIGS. 1, 11 and 12. Rather any combination of sets of holes may be considered for a plate, depending on the trolling motor that is desired to be accommodated. Furthermore, any of plates 70, 110, and 140 may have additional holes for accommodating quick release mounting pucks or inner plates of any other trolling motor. As such, the swivel mounts considered herein are not restricted to the depiction of the drawings.

It will be appreciated to those skilled in the art having the benefit of this disclosure that this invention is believed to provide swivel mounts for attaching and maneuvering accessories, such as but not limited to trolling motors, on to and over the gunnel of a boat or any other mounting surfaces. Further modifications and alternative embodiments of various aspects of the invention will be apparent to those skilled in the art in view of this description. For example, although the disclosure emphasizes swivel mounts for trolling motors, the scope of their use is not necessarily so limited. In particular, the swivel mounts disclosed herein may be considered for accessories other than trolling motors and applications other than boating. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. The term "approximately" as used herein refers to variations of up to +/−5% of the stated number. The term "coupled" as used herein refers to items being indirectly or directly connected to each other. Indirectly connected means the items are not touching each other, while directly connected means the items are touching each other.

What is claimed is:

1. A boat, comprising:

a gunnel having an upward-facing surface;

a rotating trolling motor mount bracket above the upward-facing surface of the gunnel, the bracket comprising:

an upper plate having a proximal end and a distal end, the upper plate being configured to rotate about an axis, wherein the axis (a) is substantially perpendicular to the upward-facing surface of the gunnel and an upward-facing surface of the upper plate, and (b) is closer to the proximal end than to the distal end;

wherein a length of the upper plate from the proximal end to the distal end is at least double a width of the upper plate; and a lower plate fastened to the upward-facing surface of the gunnel by at least one connector, the at least one connector extending through the upward-facing surface of the gunnel; and a trolling motor mount attached to the upper plate at two or more attachment points, wherein every attachment point on the upper plate is on the side of the axis that is closer to the distal end of the upper plate.

2. The boat of claim 1, wherein the bracket further comprises a bushing above, and attached to, an upper surface of the lower plate.

3. The boat of claim 2, wherein the upper plate is above the bushing and the upper plate is attached to both the bushing and the lower plate by at least one connector that extends through:

(a) the bushing; and (b) the upper surface of the lower plate.

4. The boat of claim 1, wherein the bracket further comprises a reinforcement plate below a downward-facing surface of the gunnel, and the reinforcement place is attached to the lower plate by the at least one connector.

5. The boat of claim 1, wherein a trolling motor mount is attached to the upper plate of the bracket by at least one second connector, the at least one second connector extending through an upward facing surface of the upper plate.

6. The boat of claim 5, wherein the trolling motor mount is part of a trolling motor assembly, wherein the trolling motor assembly further comprises:

a moveable structure with an annular opening; and a trolling motor having a shaft slidingly received within the annular opening, wherein the moveable structure is configured such that the shaft is able to move between at least two positions, wherein in a first position the shaft is arranged substantially perpendicular with a horizontal surface of the upper plate, and wherein in a second position the shaft is arranged substantially parallel with the horizontal surface of the upper plate.

7. The boat of claim 5, wherein the trolling motor mount forms a base of a quick-release trolling motor mount, and wherein the base is configured to receive:

(1) a releasable mount of the quick-release trolling motor mount; and (2) a locking pin of the quick-release trolling motor mount, wherein the locking pin is configured to secure the releasable mount to the base.

8. The boat of claim 1, wherein the upper plate of the bracket is an elongated upper plate comprising:

a first portion that includes the proximal end and is over and above the lower plate such that the axis about which the upper plate rotates passes through a region encircled by the first portion; and a second portion that includes the distal end and extends from the first portion in a plane that is substantially perpendicular to the axis.

9. The boat of claim 8, wherein the first portion of the upper plate is attached to the lower plate by at least one connector that extends through the upper surface of the lower plate.

10. An assembly, comprising:

a rotating mount having a mounting plate, a support plate, and a rotating element coupled together such that the mounting plate is able to rotate relative to the support plate about an axis passing through the support plate or through a region encircled by the support plate;

an adapter bracket connected to a portion of the mounting plate, wherein the bracket is attached to the mounting plate by one or more connectors through an upward facing surface of the mounting plate, wherein a distal end of the mounting plate is further from the axis than a proximal end of the mounting plate, and wherein each of the one or more connectors is closer to the distal end than the axis is to the distal end;

a deploy/stow bracket attached to the mounting plate via the adapter bracket; and a trolling motor having its shaft slidingly received within an annular opening of the deploy/stow bracket, wherein the deploy/stow bracket is configured such that the shaft is able to move between at least two positions, wherein in a first position the shaft is substantially perpendicular with a horizontal surface of the adapter bracket and in a second position the shaft is substantially parallel with the horizontal surface of the adapter bracket.

11. The assembly of claim 10, wherein the mounting plate is elongated and comprises:

a first portion disposed over and above the support plate and encompassing the rotating element such that the axis about which the mounting plate rotates passes through the first portion of the elongated mounting plate; and a second portion extending from the first portion.

12. The assembly of claim 11, wherein a length of the elongated mounting plate is at least twice a length of the support plate.

13. The assembly of claim 11, wherein the first portion of the mounting plate is fastened to the support plate by one or more bolts or screws through the upper surface of the support plate.

14. A trolling motor mount assembly, comprising:

a rotating mount comprising an elongated mounting plate, a support plate, and a rotator coupled together such that the elongated mounting plate is rotatable relative to the support plate about an axis passing through the support plate, wherein the support plate has a length less than or equal to half a length of the elongated mounting plate; and a trolling motor mounting bracket overlying a portion of the mounting plate without overlaying the axis about which the mounting plate rotates.

15. The trolling motor mount assembly of claim 14, wherein the trolling motor mounting bracket is a mounting base of a trolling motor assembly, and wherein the trolling motor assembly further comprises:

a moveable structure; and a trolling motor having a shaft slidingly received within an annular opening of the moveable structure, wherein the moveable structure is configured such that the shaft is able to move between at least two positions, wherein in a first position the shaft is substantially perpendicular with a horizontal surface of the mounting base, and in a second position the shaft is substantially parallel with the horizontal surface of the mounting base.

16. The trolling motor mount assembly of claim 14, wherein the trolling motor mounting bracket is a base of a quick-release bracket, wherein the trolling motor mounting bracket is configured to receive a releasable mount of the quick-release bracket and further receive a locking pin of the quick-release bracket to secure the releasable mount.

17. The trolling motor mount assembly of claim 14, wherein the trolling motor mounting bracket is fastened to the mounting plate by one or more bolts or screws through an upward facing surface of the mounting plate.

18. The trolling motor mount assembly of claim 14, wherein the mounting plate is an elongated mounting plate comprising:

a first portion disposed over and above the support plate and encompassing the rotator such that the axis about which mounting plate rotates passes through a region encircled by the first portion; and a second portion extending from the first portion.

19. The trolling motor mount assembly of claim 18, wherein the first portion of the mounting plate is fastened to the support plate by one or more bolts or screws through the upper surface of the support plate.

20. A rotating trolling motor mount bracket for attachment to an upward-facing surface of a gunnel, the bracket comprising:

an elongated upper plate configured to rotate about an axis, wherein the axis:

(a) is substantially perpendicular to an upward-facing surface of the upper plate; and (b) passes through the upward-facing surface of the upper plate or a region encircled by the upward-facing surface of the upper plate;

wherein, a length of the upper plate is at least two times a width of the upper plate, the upper plate having a distal end and a proximal end, wherein the proximal end is closer to the axis than the distal end, wherein the upper plate has a plurality of attachment points for attaching a trolling motor or a trolling motor mount, wherein the plurality of attachment points are holes that pass through the upper plate, wherein all of the plurality of attachment points are closer to the distal end than the axis is to the distal end; and a lower plate rotatably attached to the upper plate by at least one connector for rotation of the upper plate about the axis.

21. The bracket of claim 20, wherein the plurality of attachment points comprises a hole pattern to accommodate at least two different types of trolling motors, and wherein the upper plate includes a through hole for a locking pin assembly.

22. The bracket of claim 21, wherein the upper plate and the lower plate comprise a T6 hardened aluminum alloy.

23. The bracket of claim 21, wherein the bracket comprises a locking pin assembly inserted into the through hole.

24. The bracket of claim 23, wherein the locking pin assembly is spring-loaded and a locking pin of the locking pin assembly is oriented perpendicular to the axis.

25. The bracket of claim 24, wherein the bracket further comprises a bushing above, and attached to, an upper surface of the lower plate, wherein the upper plate is above the bushing and the upper plate is attached to both the bushing and the lower plate by at least one connector, wherein the at least one connector extends through (a) the bushing and (b) the upper surface of the lower plate, and wherein a length of the lower plate is no more than half the length of the upper plate and the lower plate has a plurality of gunnel attachment points for attachment to a gunnel.

* * * * *